US009051760B2

(12) United States Patent
Herrmann

(10) Patent No.: US 9,051,760 B2
(45) Date of Patent: Jun. 9, 2015

(54) CYLINDER LOCK WITH SIDE BAR AND SIDE PINS, KEY AND LOCK ASSEMBLY

(75) Inventor: Jonas Herrmann, Eskilstuna (SE)

(73) Assignee: ASSA OEM AB, Eskilstuna (SE)

( * ) Notice: Subject to any disclaimer, the term of this patent is extended or adjusted under 35 U.S.C. 154(b) by 0 days.

(21) Appl. No.: 13/512,655

(22) PCT Filed: Dec. 16, 2010

(86) PCT No.: PCT/SE2010/051405

§ 371 (c)(1),
(2), (4) Date: May 30, 2012

(87) PCT Pub. No.: WO2011/075069

PCT Pub. Date: Jun. 23, 2011

(65) Prior Publication Data

US 2012/0240646 A1 Sep. 27, 2012

(30) Foreign Application Priority Data

Dec. 18, 2009 (SE) ..... 0950985

(51) Int. Cl.

| | |
|---|---|
| ***E05B 19/06*** | (2006.01) |
| ***E05B 27/06*** | (2006.01) |
| ***E05B 27/10*** | (2006.01) |
| ***E05B 27/00*** | (2006.01) |
| *E05B 19/00* | (2006.01) |

(52) U.S. Cl.

CPC ..... *E05B 27/0082* (2013.01); *E05B 19/0035* (2013.01); *E05B 27/0017* (2013.01)

(58) Field of Classification Search

CPC ..... E05B 19/0023; E05B 19/0035; E05B 19/0058; E05B 27/0017; E05B 27/0078; E05B 27/0082

USPC ..... 70/376, 378, 392, 409, 492–496, 358, 70/405–407

See application file for complete search history.

(56) References Cited

U.S. PATENT DOCUMENTS 1,244,450 A * 10/1917 Christoph ..... 70/492
2,111,515 A * 3/1938 Rauh ..... 70/493

(Continued)

FOREIGN PATENT DOCUMENTS

| | | |
|---|---|---|
| JP | 62180158 U | 11/1987 |
| SE | 469565 B | 7/1993 |
| WO | 0014367 A1 | 3/2000 |

OTHER PUBLICATIONS

International Search Report re PCT/SE2010/051405, date of mailing Feb. 3, 2011.

*Primary Examiner* — Lloyd Gall
(74) *Attorney, Agent, or Firm* — Perkins Coie LLP

(57) ABSTRACT

A cylinder lock comprising a cylinder housing (2), a cylinder core (4) having a key channel (5) arranged in the cylinder housing (2), at least one side bar (6, 7) arranged between the cylinder housing (2) and the cylinder core (4) and a plurality of side pins (20) arranged on at least one side of the key channel (5) and arranged to be lifted by insertion of a key (8) and in cooperation with the side bar (6, 7) allow or prevent relative rotation of the cylinder housing (2) and the cylinder core (4), wherein each side pin (20) comprises a foot (26, 29) adapted to be lifted by a code groove (10) in the side surface (12) of the key. The cylinder lock is characterized in that the foot (26) of at least one of the side pins (20) is tapered. A key (8) for the cylinder lock having a groove for side pins having a tapered foot is also described.

16 Claims, 5 Drawing Sheets

(56) References Cited

U.S. PATENT DOCUMENTS

| | | | | | |
|---|---|---|---|---|---|
| 2,123,940 | A | * | 7/1938 | Gray | 70/492 |
| 4,393,673 | A | * | 7/1983 | Widen | 70/358 |
| 4,756,177 | A | | 7/1988 | Widen | |
| 5,502,991 | A | * | 4/1996 | Sornes | 70/453 |
| 5,517,840 | A | | 5/1996 | Haggstrom | |
| 5,819,566 | A | * | 10/1998 | Eden, Jr. | 70/358 |
| 5,823,029 | A | * | 10/1998 | Eden, Jr. et al. | 70/358 |
| 5,964,112 | A | * | 10/1999 | Stefanescu | 70/493 |
| 8,210,009 | B2 | * | 7/2012 | Widen | 70/409 |
| 8,230,708 | B2 | * | 7/2012 | Widen | 70/409 |
| 8,281,628 | B2 | * | 10/2012 | Widen | 70/409 |

* cited by examiner

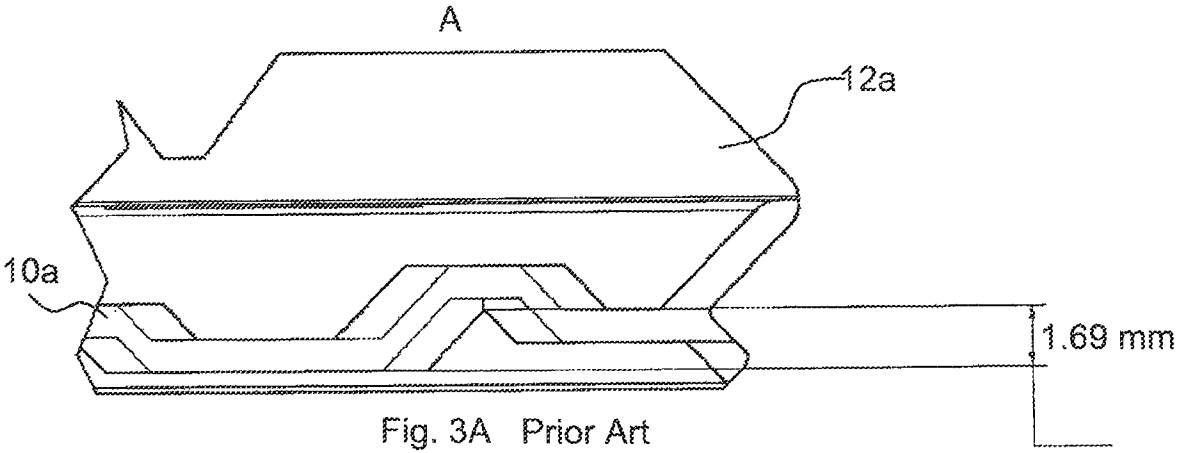
Fig. 3A Prior Art
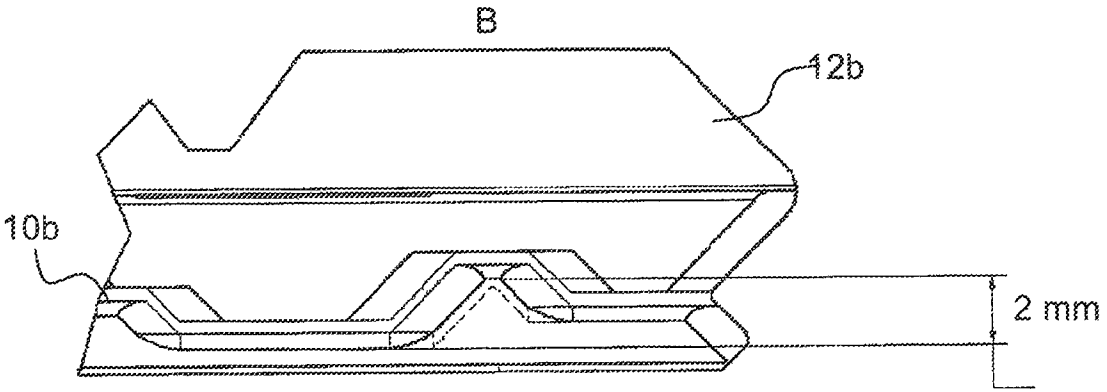
Fig. 3B
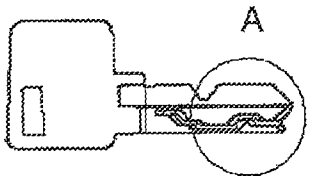
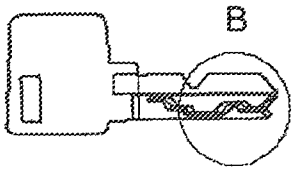

CYLINDER LOCK WITH SIDE BAR AND SIDE PINS, KEY AND LOCK ASSEMBLY

TECHNICAL FIELD

The invention relates to a cylinder lock comprising side pins and a side bar arranged between the cylinder core and the cylinder house, and to keys for such cylinder locks.

BACKGROUND AND PRIOR ART

The invention relates to cylinder locks having side pins and side bar. Normally, this type of cylinder locks comprises a cylinder core and a cylinder housing, having the cylinder core arranged inside the cylinder housing and a side bar arranged in a space between the cylinder housing and the cylinder core. In a locked state, the side bar or blocking/latching bar is engaging and interfering with the cylinder housing and cylinder core and thereby prevents rotational movement of these in relation to each other. When the side pins are lifted by means of a key (code carrier) to a correct level by means of a groove in the side surface of the key, the side bar can be moved from engagement with the cylinder housing, and be pushed into the cylinder core and leave its locking position between the core and housing of the cylinder lock and thereby allow rotation of the cylinder core inside the cylinder housing so that the lock is opened. Such a lock is described in the Swedish patent document SE469565.

A combination of cylinder lock and key is shown in the Swedish patent SE-469565 (see figures) wherein the key (4) is provided with a groove in each of its side surfaces for engaging with code pins (5) arranged at opposite sides of the key-way (3 *a*) of the cylinder core. The groove runs along the side surfaces of the key and varies in elevation and when the key is inserted into the lock the pins are forced vertically, perpendicular to the direction of insertion of the key, upwards and downwards inside the cylinder core. The pins are essentially cylindrical and show narrower middle portions for receiving a blocking rod (6) when they are positioned in the correct code level lifted by the key. Depending on such factors as the number of code pins, the length of the key and height there are physical limits for the number of code possibilities. Even if the height of the key is large, the possibility to employ this height is limited. This is due to the resistance created when the code pins are pushed upwards and downwards by the groove of the key which becomes large for a large rise. For the same reason the variation in code level between two adjacent code pins is limited. A rise that is approximately 45 degrees at maximum creates very little resistance. Also the space available for the code pins in the cylinder core limits the maximal movement of the code pins and thereby the space available for coding levels.

SUMMARY OF THE INVENTION

An aim of the invention is to provide a cylinder lock having more possibilities for coding. This is achieved through an improved use of the dimensions of the cylinder lock, so that the available space of the lock and of the key is employed to a larger extent.

The invention provides a cylinder lock comprising a cylinder housing provided with a key channel, or key-way, arranged in the cylinder housing, at least one latching bar arranged between the cylinder housing and the cylinder core and a plurality of side pins arranged on at least one side of the key channel and arranged to be lifted by an inserted key and in cooperation with the blocking bar allow or prevent relative rotation of the cylinder housing and the cylinder core. Each side pin is further provided with a foot adapted to be lifted by a groove in the side surface of the key. The foot of at least one of the side pins is tapered. In this way, enhanced coding possibilities are provided by means of making it possible to prolong the stroke of the coding pins in the cylinder core. Moreover, the inclination rise, or climbing, of the code pin along the key is facilitated. In this way, the variation in code level for a given distance along the key, such as the distance between two code pins, can be increased and thereby also the total number of code levels available along the key length.

The foot of the code pin is preferably tapered in a direction from the key channel towards the cylinder housing. The foot is preferably also tapered towards the key, i.e. from the cylinder house towards the key channel. Preferably the foot is tapered in both these directions.

In a preferred embodiment the tapered foot is conical. In this case, the foot comprises a tapering both against the key and the cylinder housing. This also facilitates rotation of the code pin, so that the foot can "roll" along the key when the key is inserted in through the key channel, and this rotation decrease the friction and thereby also the wear.

In an embodiment, the conical foot is formed as a truncated cone pointing downwards.

In an embodiment, the foot of a least one of the side pins is mounted to the side pin.

In an embodiment, the tapering of the tapered foot is designed so that it provides an angle of between 10 and 50 degrees, preferably between 20 and 40 degrees, preferably approximately 30 degrees, in relation to the longitudinal direction of the key when the key is inserted into the key channel.

In an embodiment, the tapered foot is designed so that it provides an angle of between 40 and 80 degrees, preferably between 50 and 70 degrees, preferably approximately 60 degrees in relation to the longitudinal direction of the side pin.

In an embodiment, at least one further side pin is provided with a tapered foot in accordance with the foot of the at least one side pin, and preferably all side pins are provided with a tapered foot, formed in essentially the same way. At least all side pins present on the same side of the key channel and which during use cooperates with the same side surface of the key of the lock.

In an embodiment, the side pin, preferably all of the side pins, is rotatably arranged in the cylinder core.

The invention also provides a key having at least one code groove for side pins of a cylinder lock, which code groove varies in elevation along the side of the key. The code groove forms a channel with two sides, and preferably also a base or bottom. Alternatively, there is no bottom and the sides of the channel meet each other and forms, in a cross section of the channel, two sides of a triangle wherein the third side is provided by the open groove in the side surface of the key. The key is characterized in that one of the side surfaces of the code groove is leaning, in a cross section of the code groove, so that it is adapted for cooperation with a tapered foot of a side pin. Preferably the lower surface of the groove, which is arranged for lifting the side pins of the cylinder lock, i.e. the lower surface in relation to the key.

The inclined surface separates the key from previous keys where the channel in the side of the key is provided with side surfaces that are perpendicular in relation to the side surface of the key and where the bottom of the channel, in the cross section of the channel, is perpendicular in relation to the sides of the channel and also parallel with the side of the key. The key, according to the invention, is provided with a channel with an inclined side surface. This inclined side surface of the channel is preferably the side that is directed towards the back, or lower side, of the key. In the embodiment wherein the channel comprises a bottom, the bottom is preferably flat and, in the cross section of the channel, is preferably parallel to the side surface of the key. The upper channel side of code groove forms a straight angle in relation to the key side, in the cross section of the channel, and also in relation to a possible bottom of the channel.

In a preferred embodiment of the key, the first inclined side surface of the code groove is inclined between 40 and 80 degrees, preferably between 50 and 70 degrees, preferably approximately 60 degrees in relation to the side surface of the key and the height direction of the key.

Preferably therefore the code groove also comprises a second side surface that extends from the side surface of the key to the bottom of the groove, wherein the second side surface of the cross section of the code groove is essentially perpendicular in relation to the side surface of the key.

In a preferred embodiment the code groove of the key forms a meandering pattern running from the front edge of the key, and which pattern is adapted to move the side pins of the cylinder lock upwards and downwards to different code levels when the key is inserted in the lock.

BRIEF DESCRIPTION OF THE DRAWINGS

The invention will now be described further in embodiments with reference to the figures wherein details of the design are illustrated to facilitate the invention being carried out.

FIGS. 3A, 3B illustrate a key with a side groove.

DESCRIPTION OF EMBODIMENTS

Figure 1:
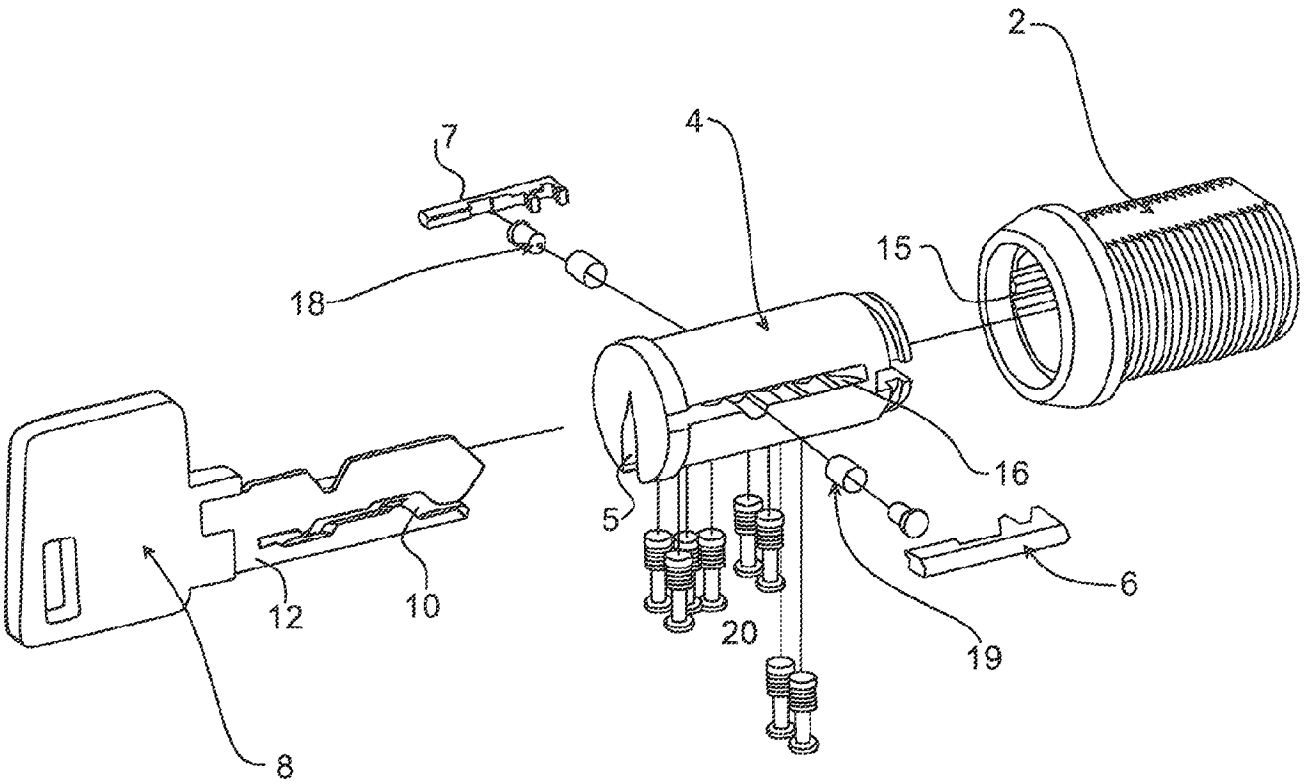
FIG. 1 shows an exploded view of a cylinder lock.

A first embodiment of a cylinder lock is illustrated in FIG. 1, which cylinder lock comprises a cylinder housing 2, a cylinder core 4 provided with a cylinder profile (key-way) or key channel 5, a plurality of side pins 20 and two side bars 6, 7 arranged on opposite sides of the key channel 5. The side bars 6, 7 are further arranged in recesses 15, 16 in the cylinder core 4 as well as in the cylinder housing 2 for baring or blocking their relative movement when the lock is locked, and the side bars 6, 7 are arranged to be pushed into the cylinder core 4, when the lock is being unlocked, out of engagement with the side bar recess 15 in the cylinder housing 2 so that the cylinder core 4 can rotate in relation to the cylinder housing. When the key is rotated, the side bars 6, 7 are pushed out from the respective side bar recess 15 in the direction towards the cylinder core. With the correct key, the side pins are lifted to correct code level and allows the movement of the side bars 6, 7 into the side bar recess 16 of the cylinder core. Using the wrong key, the side pins blocks the movement of the side bar.

FIG. 1 also shows a key 8 or code carrier intended for being inserted into the key channel 5 and being provided with a code groove 10 in its two side surfaces 12. Each side surface 12 is provided with a code groove 10, and it is preferred that keys according to the invention are provided with only one code groove per side 12. When the key is inserted into the cylinder core 4, the side surfaces 12 with the code grooves 10 face away from opposite sides of the channel 5. Each code groove 10 extends from the front edge of the key, which front edge meets the side pins first during insertion, and along the key in a pattern that varies in height elevation. Each code groove forms height levels, so called code levels, along the key. These side oriented code grooves 10 are formed to in engagement cooperate with code pins, or side pins, 20 positioned in the cylinder core 4 on opposite sides of the key channel 5, and move the side-positioned code pins 20 in height when the key 8 is inserted through the key slot and the key channel 5. When the side pins 20 are lifted to correct height level, the side pins allow that the side bars 6, 7 are pushed into the cylinder core 4 and thereby out of engagement with the recess 15 and the cylinder housing 2 so that the cylinder core 4 can rotate inside the cylinder housing 2. Each side bar 6, 7 is biased or prestressed away from the cylinder core 4 in a direction towards the cylinder housing 2 and the recess 15. The bias is provided by means of biasing device 18, 19 comprising a spring 18 and a piston 19.

The key can also be provided with an indentation in the form of bit of key or bittings for divided locking pins positioned above the key channel.

Figure 2B:
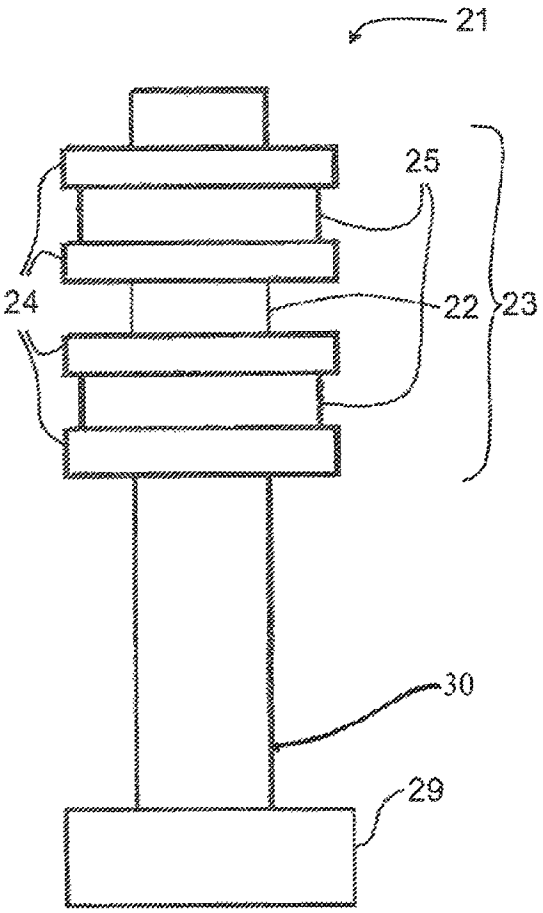
Fig. 2B Prior Art
FIGS. 2A, 2B show a side pin according to the prior art and a side pin according to the invention.
Figure 2A:
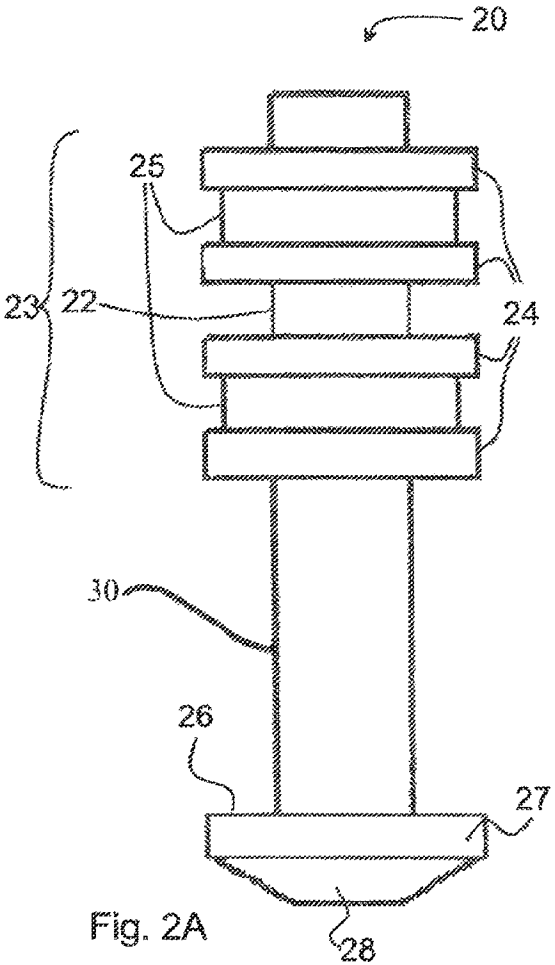

FIG. 2 illustrates two side pins 20, 21. Each one of the side pins 20, 21 comprises a body 23 formed to cooperate with a side bar. For this purpose, the body 23 is provided with at least one waist 22 which allows movement of the side bar 6, 7 in the direction towards the side pin 20, out of engagement with the cylinder housing, and also on another level provided with at least one portion that prevents movement of the side bar and thereby keeps the side bar 6, 7 in engagement with the cylinder housing 2. The body in the figure also comprises false grooves 25 that are provided for making picking of the lock more difficult, which flase grooves prevent rotation of the side bar. Thus, the body 23 show two different surfaces for cooperating with the side bar, open surfaces 22, which allow movement of the side bar 6, 7 into the core 4, and also closed surfaces 24, 25 that prevent movement of the side bar 6, 7 into the core. The side pins 20, 21 also comprise a respective foot 26, 29 coupled to the body 23 by a shaft 30. The foot 26, 29 is intended and adapted for lifting, when engaging a key inserted in the key channel, the side pin so that one portion, such as the waist or a preventing portion of the side pin arrives at the level of the side bar. The side pin 21, to the right in FIG. 2B, is provided with a foot 29 that has an essentially cylindrical shape, as is previously known. The left side pin 21, of FIG. 2A, is provided with a foot 26 that is tapered. The foot 26 has a cylindrical portion 27 and a conical portion 28. The conical portion 28 has the shape of a truncated cone, pointing downwards (i.e. the conical portion converges in a direction pointing away from the body 23). The conical shape 28 of the foot presents a thinner outer edge, but still provides sufficient strength having increasing thickness inwards towards the pin. The tapering of the conical portion 28 of FIG. 2A forms an angle of approximately 60 degrees in relation to the longitudinal direction of the pin 20.

FIGS. 3A and 3B illustrate two keys having code grooves 10 *a* and 10 *b*, respectively, provided in each side surface of each respective key. The code grooves 10 *a*, 10 *b* forms a pattern that varies in height level along the side surface of the key. The key of FIG. 3A is provided with a code groove 10 *a* that is formed for side pins having a cylindrical foot portion. The code groove 10 *a* is shaped with straight sides and a flat bottom in side surface 12 *a*, and presents a rectangular cross section. The key of FIG. 3B comprises a code groove 10 *b* formed for a side pin having a tapered foot portion, especially conical foot portions. In such side grooves 10 *b*, one side is straight, while the other is inclined at an angle (11 in FIG. 5) and the bottom is straight. The inclination of the grooves 10 *a*,

10 *b* is approximately 45 degrees. Having a conical lower part on the foot of each respective side pin, the uprising and descending, towards a higher, and lower, respectively, code level will start earlier, so that the height difference between two successive code levels in groove 10 *b* can be made larger than in groove 10 *a*. In this way a greater variation of code levels is provided along the key in a cylinder lock comprising side pins having tapered foot portions and keys adapted for the tapered foot portion. Thus the, so called, MACS of the key ("Maximum Adjacent Cut Specification") becomes larger. The figure illustrates an example where the key 12 *a*, which is adapted for side pins having cylindrical foot, provides arise between two side pins of 1.69 mm. The Key 12 *b*, for the tapered foot, have the same size as the key 12 *a*, but the rise between two side pins may be as large as 2.0 mm. Having a code level difference of 0.5 mm, the key 12 *a* for cylindrical feet can be used for a maximum of 3 levels of code level differences, while key 12 *b* and the lock having tapered foot of the side pins can be used for a code level difference of a maximum of 4 levels. Thus, a key adapted for side pins having tapered foot comprising a side groove with a non-rectangular cross section and an inclined surface provides a safer key by means of providing a greater code variation and a greater number of available code levels.

Figure 4B:
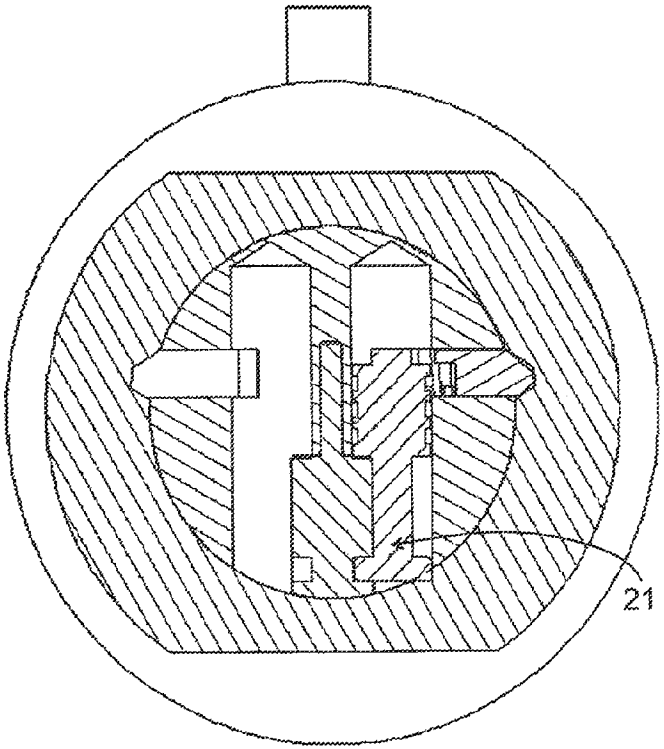
FIGS. 4A, 4B illustrate a cross section of a cylinder lock through a cylinder house, cylinder core, side pin and key.
Figure 4A:
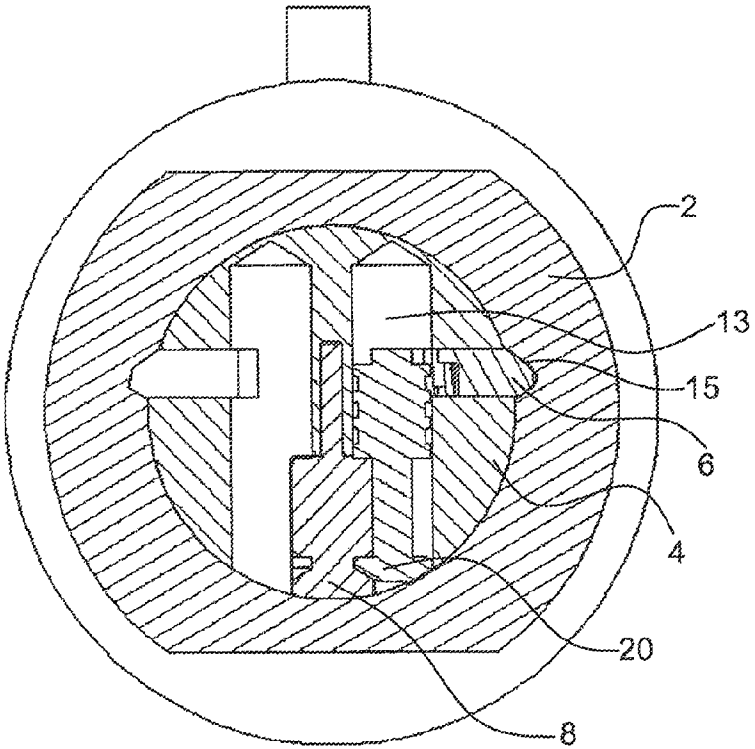

FIG. 4A illustrates a cross section of an embodiment of a cylinder lock in accordance with the invention. The cross section extends through the cylinder housing 2, the cylinder core 4, side bar 6, a side pin 20 and the key 8. The figure also illustrates the compartment 13 for the side pin 20 in the cylinder core 4. The side pin 20 is essentially cylindrical and provided with a conically tapered foot 27. The FIG. 4A shows that the side pin can be mounted lower due to the tapering of the foot 26 and the height extension of the key can also be better utilized. FIG. 4A also illustrates how the side bar 6 is positioned in a recess 15 in the cylinder housing 2, which recess 15 is formed having angled surfaces and adapted to cooperate with the corresponding outer middle portion of the side bar 6 to push the side bar 6 from the cylinder housing 2 when the cylinder core 4 is turned around.

FIG. 4B is an illustration for comparing a side pin 21 having a cylindrical foot where the side pin is positioned at the same low level as the side pin 20 of FIG. 4A. The side pin 21, having a cylindrical foot, does not, in this low position, have room in the cylinder core, instead it extends out of the core and into the cylinder housing.

Figure 5:
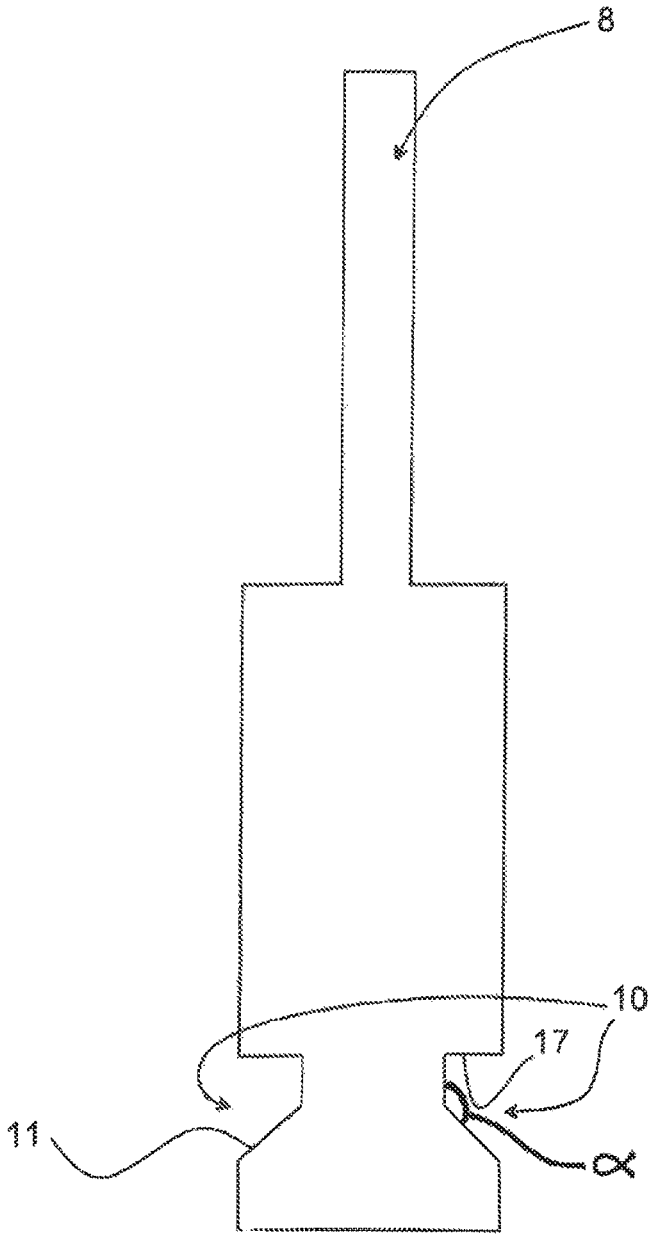
FIG. 5 illustrates a side groove in a key in accordance with the invention.

FIG. 5 illustrates the profile of the key 8 more clearly, having a code groove 10 arranged on each side surface. The code groove 10 comprises an inclined surface 11 closest to the lower edge of the key, which side leans 45 degrees in relation to the height extension of the key. As shown in FIG. 5, the inclined surface 11 forms an obtuse angle $\alpha$ with the bottom of the code groove. The code groove comprises two sides that extend from the side surface 12 of the key to the bottom of the groove, a first side that has an angle of approximately 45 degrees in relation to the side surface and the other side that is essentially perpendicular to the side surface.

By forming the side pins provided with conically downward directed ends, the height of the key can be more efficiently used and by adapting the groove 10 of the key in accordance with these the height variation of the code groove can be made greater. In this way a combination of a cylinder lock and key with cylindrically shaped foot on each side pin and whose dimensions previously made six code levels possible and a maximum variation of four code levels between two consecutive side pins is enhanced so that such a combination can provide seven code levels and a variation of five code levels between two consecutive side pins.

The invention claimed is:

1. A cylinder lock comprising a cylinder housing, a cylinder core having a key channel arranged in the cylinder housing, said key channel arranged to receive a key with a meandering code groove, at least one side bar arranged between the cylinder housing and the cylinder core and a plurality of side pins positioned on at least one side of the key channel, the side pins being arranged to be lifted by the meandering groove of the key upon insertion of the key in the key channel, each of the side pins comprising a shaft and a body that in cooperation with the at least one side bar allow or prevent relative rotation of the cylinder housing and the cylinder core depending on whether the plurality of side pins being lifted to a correct code level, wherein each side pin comprises a foot, which is connected to the body by the shaft, said foot arranged to be lifted by the meandering code groove in the key upon insertion of the key in the key channel, the foot of at least one of the side pins being tapered, wherein each tapered foot comprises a cylindrical portion having a diameter essentially equal to an outer diameter of the body and greater than a diameter of the shaft and a conical portion, said conical portion being formed as a rectilinearly truncated cone converging in a direction away from the body of the side pins.

2. A cylinder lock according to claim 1, wherein the tapering of the foot of at least one of the side pins provides an angle in relation to the longitudinal direction of the side pin of between 40 and 80 degrees.

3. A cylinder lock according to claim 1, comprising at least two side pins provided with a respective tapered foot, each tapered foot comprising a cylindrical portion and a conical portion being formed as a rectilinearly truncated cone converging in a direction away from the body of the side pins.

4. A cylinder lock according to claim 3, wherein all of the side pins are provided with a tapered foot.

5. A cylinder lock according to claim 1, where at least one of the plurality of side pins is arranged in order to rotate together with the cylinder core.

6. A cylinder lock according to claim 1, comprising a plurality of side pins positioned on the other side of the key channel.

7. A lock assembly comprising a cylinder lock according to claim 1 and at least one key for the cylinder lock, wherein the key comprises at least one code groove in at least one side surface of the key, the at least one code groove forming a meandering pattern from a front edge of the key, characterized in that the at least one code groove has a cross section having a first side surface with an inclination adapted to engage and move a tapered foot of a side pin of the cylinder lock when the key is inserted into the cylinder lock, which tapered foot comprises a cylindrical portion and a conical portion, said conical portion being formed as a rectilinearly truncated cone converging in a direction away from the body of the side pins.

8. A cylinder lock according to claim 2, wherein the angle is between 50 and 70 degrees.

9. A cylinder lock according to claim 8, wherein the angle is approximately 60 degrees.

10. A cylinder lock according to claim 1 further comprising a key with a meandering code groove.

11. A key for a cylinder lock provided with side pins, wherein the key comprises: at least one code groove in at least one side surface of the key, the at least one code groove forming a meandering pattern from a front edge of the key, said at least one code groove arranged to be capable of lifting side pins on at least one side of a key channel of the cylinder lock when the key is inserted into the key channel of the cylinder lock characterized in that the at least one code groove is provided with a cross section having a first side surface closest to a lower edge of the key, a bottom, and a second side surface, which first side surface is inclined in relation to the height extension of the key, the first side surface extends from the side surface of the key to a bottom of the at least one code groove and wherein the inclination of the first side surface is substantially continuous from the side surface of the key to the bottom of the at least one code groove, the first side surface of the cross section of the at least one code groove being non-perpendicular to the side surface of the key and forming an obtuse angle with the bottom of the at least one code groove.

12. A key according to claim 11, wherein the first side surface of the cross section of the at least one code groove has an angle of between 40 and 80 degrees in relation to the side surface of the key.

13. A key according to claim 12, wherein the cross section of the at least one code groove comprises a second side surface extending from the side surface of the key to the bottom of the at least one code groove, wherein the second side surface of the cross section of the at least one code groove is essentially perpendicular in relation to the side surface.

14. A key according to claim 12, wherein the angle is between 50 and 70 degrees in relation to the side surface of the key.

15. A key according to claim 14, wherein the angle is approximately 60 degrees in relation to the side surface of the key.

16. A key according to claim 14, further comprising a lock wherein the lock comprises a cylinder lock having a key channel cooperatively sized to receive the key, wherein the lock further comprises side pins on at least one side of the key channel such that the side pins are lifted by the at least one code groove on the key.

* * * * *